US007480952B2

(12) United States Patent
Nickerson et al.

(10) Patent No.: US 7,480,952 B2
(45) Date of Patent: Jan. 27, 2009

(54) INFLATABLE BODY WITH INDEPENDENT CHAMBERS AND METHODS FOR MAKING THE SAME

(75) Inventors: L. Paul Nickerson, Seattle, WA (US); Philip R. Hitch, Seattle, WA (US)

(73) Assignee: Cascade Designs, Inc., Seattle, WA (US)

( * ) Notice: Subject to any disclaimer, the term of this patent is extended or adjusted under 35 U.S.C. 154(b) by 314 days.

(21) Appl. No.: 11/259,853

(22) Filed: Oct. 26, 2005

(65) Prior Publication Data

US 2006/0101743 A1 May 18, 2006

(51) Int. Cl.
*A47C 27/10* (2006.01)
*A47C 27/14* (2006.01)

(52) U.S. Cl. ..... 5/655.3; 5/654; 5/709; 5/710; 5/932

(58) Field of Classification Search ..... 5/932, 5/655.3, 709, 710, 711, 712, 654, 644
See application file for complete search history.

(56) References Cited

U.S. PATENT DOCUMENTS 3,918,110 A * 11/1975 Cantillo et al. ..... 5/687
5,282,286 A 2/1994 MacLeish
6,185,770 B1 * 2/2001 Wang ..... 5/706
6,463,610 B1 10/2002 Shulte et al.
6,651,277 B1 11/2003 Marson

* cited by examiner

*Primary Examiner*—Alexander Grosz
(74) *Attorney, Agent, or Firm*—Graybeal Jackson LLP

(57) ABSTRACT

An inflatable body including first and second fluid impervious major panels, each having an outer surface, an inner surface and a perimeter, and further including a fluid impervious intermediate panel having a first surface, a second surface and a perimeter. A first perimeter portion of the intermediate panel is joined to the inner surface of the first major panel from one perimeter portion thereof to a generally opposed perimeter portion thereof, and a second perimeter portion of the intermediate panel, which is generally opposed to the first perimeter portion, is joined to the inner surface of the second major panel from one perimeter portion thereof to a generally opposed perimeter portion thereof. The first and second major panel perimeters are joined to each other, defining a primary enclosure having first and second chambers separated by the intermediate panel, and at least one sealable orifice in fluid communication with the environment and at least one chamber.

20 Claims, 2 Drawing Sheets

INFLATABLE BODY WITH INDEPENDENT CHAMBERS AND METHODS FOR MAKING THE SAME

BACKGROUND OF THE INVENTION

Inflatable bodies such as mattresses and cushions are used for a variety of purposes. In certain applications, especially in the medical fields, it is particularly desirable to modify the resiliency or Indentation Force Deflection ("IFD") value of a mattress or a cushion over a given area. For example, and with respect to seating cushions, various portions of a user's anatomy require different levels of support. This recognition lead to the development of the invention disclosed in U.S. Pat. No. 5,282,286, which is incorporated herein by reference. Here, discrete resilient slabs of material are placed adjacent to one another within a single envelope or enclosure to provide different zones of IFD values. While achieving the objective of providing differentiated zones of IFD values within a single self-inflating seat cushion, the invention did not provide for modulating the cushion's internal air pressure for each or several zones.

Other attempts have been made in this respect. U.S. Pat. No. 6,463,610, for example, discloses a multi-chambered air bed that utilizes discrete tension members in the form of coils to provide mattress stability and prevent distension of the bed's outer sheets when internal pressure increases. The multiple chambers are created by establishing a septum or barrier within a larger sealed volume.

An alternative arrangement disclosing a composite structure is found in U.S. Pat. No. 6,651,277. In this invention, a self-inflating pad is combined with a means for receiving an auxiliary structure to modify the nature of the support. However, if unique zones of IFD values are desired, the modifications must be made to the auxiliary structure, which will either minimize the benefits of the self-inflating pad portion or result in sharp transition zones if the structure is not homogeneous.

SUMMARY OF THE INVENTION

The invention is directed to an inflatable body having independent fluid fillable chambers defined in part by common surfaces, and methods for making the same. The inflatable body comprises a first major panel and a second major panel together defining a primary enclosure. While the major panels are preferably unitary, the invention will still operate if one or both panels comprise a plurality of panel portions joined to form a single panel. Also, while the major panels are preferably fluid impervious, the invention will still operate if one or both panels are not fluid impervious.

Each major panel has an outer surface, an inner surface and a perimeter. By placing the major panels in opposition and joining the respective perimeters, the primary enclosure is formed. In addition to the foregoing, at least one intermediate panel extends from the inner surface of one major panel to the inner surface of the other major panel, thereby dividing the interior portions of the major panels into two zones. The intermediate panel comprises a first side, a second side, and a perimeter. If the intermediate panel extends from one major panel perimeter to another major panel perimeter, then at least two chambers are created when the major panels are joined at their respective perimeters. The intermediate panel may be fluid impervious or fluid porous, depending upon design considerations.

A feature of the invention relates to the means by which the intermediate panel is joined to the inner surfaces of the major panels. If independent and isolated chambers are desired, it is advisable to have a fluid impervious intermediate panel extend from one major panel perimeter to another, and to have perimeter portions of the intermediate panel joined to respective major panels as previously described. Thus, a first perimeter portion of the intermediate panel is joined to the inner surface of the first major panel from one perimeter portion thereof to another, and preferably opposing, perimeter portion thereof. A second perimeter portion of the intermediate panel, preferably opposed to the first, is joined to the inner surface of the second major panel from one perimeter portion thereof to another, and preferably opposing, perimeter portion thereof. Therefore, when the major panel perimeters are subsequently joined, two chambers are formed with each sharing at least one common major panel.

By extending the intermediate panel into the perimeter portion of both major panels, it is possible to effectively join the two major panels without modification to construction techniques for standard non-chambered bodies: the use of an intermediate panel with joining properties similar to those of the major panels ensures that, when the major panels are joined at their respective perimeters, the subsequent connection transcends the intermediate panel. Further, if care is taken to minimize bunching at the intermediate panel perimeter, the aesthetic qualities of the resulting product are similar to conventional, non-chambered inflatable bodies. Furthermore, because only the perimeter portions of the intermediate panel are subject to joining with the major panels, the techniques used to achieve this association need only be present or applied to those portions of the intermediate panel, e.g., the low melting point urethane coating need only be established at the perimeter of the intermediate panel.

Disposed in each of the chambers is a material capable of acting as a tensile member to limit the degree of separation (distension) between the two major panels when a chamber is pressurized. In a preferred embodiment, a slab of open cell foam having opposing major surfaces and a perimeter is used. A non-exclusive list of alternative materials includes random or oriented fiber batting (preferably constructed from polyester), films (preferably derived from a polyurethane material), yarns, drop-stitched threads and/or yarns, and textiles coated with bondable thermoplastic or reactive coatings (collectively referred to as tensile members). In order to function as tensile members, it is necessary to mechanically link the outer surface of the tensile member to the inner surfaces of the major panels. This linkage can be accomplished by use of thermoplastic thermal welding, adhesives, hot melts, RF welding, reactive adhesives (including UV), dropped-stitched fabric that is subsequently coated and microwave welding.

In preferred embodiments, the inner surface of each major panel has a coating of low melting point polyurethane such that, when subject to heat and compression against tensile members, outer surface portions of the tensile members are embedded into the coating and remain anchored thereto after cooling of the same. While bonding of the tensile members to the major panels immediately adjacent to the joined perimeters is possible, preferred embodiments do not bond lateral portions of the tensile member(s) to the major panels; the intermediate panel area between opposing perimeter sections is generally not joined or bonded to the resilient material, although in so doing performance of the composite structure would not be adversely affected.

A similar range of linkage means exists with respect to the joining of the intermediate panel with the major panels (contacting surfaces have a low melting point polyurethane coating), except that it is considered desirable to ensure a uniform and fluid impervious joinder, if fully isolated and independent chambers are desired.

Methods for constructing an embodiment according to the invention involve (a) joining a first perimeter portion of an intermediate panel to an inner surface of a first major panel; (b) joining a second perimeter portion of an intermediate panel, generally in opposition to the first perimeter portion, to an inner surface of a second major panel; (c) securing at least a portion of at least one tensile member to the inner surfaces of both the first and second major panels; and (d) sealingly joining opposing perimeter portions of the first and second major panels to establish an envelope having at least one sealable orifice wherein at least a portion of the intermediate panel extends into sealed perimeter portions of the first and second major panels and whereby the presence of the intermediate panel creates at least two discrete chambers.

A preferred method for establishing the joining of the intermediate panel to the first and second inner surfaces of the major panels involves the use of a heated Teflon™ (PTFE) covered bar in combination with a heated platen, wherein both the inner surfaces of the major panels and preferably at least the perimeter portions of the intermediate panel have a heat bonding agent, such as low melting point polyurethane. Depending upon its implementation, the following procedure can be carried out sequentially, or in combination; for simplicity, a sequential procedure is first described. A heated platen is positioned adjacent to the uncoated side of the first major panel, which is preferably facing down. A perimeter portion of the intermediate panel is placed on top of the coated inner surface and a heated Teflon covered bar is paced above it so that the two panels are between the platen and the Teflon covered bar. A bond is created by heat and the two panels are thusly joined. A similar procedure is applied with respect to the opposing intermediate panel perimeter and the inner surface of the second major panel. For a single step process, two platens are used and either a single split Teflon covered bar or two Teflon covered bars are employed. Of course, those persons skilled in the art will appreciate the multitude of means available for joining the respective panels, depending in large part upon the composition of the panels, the bonding agent(s) and other considerations.

DESCRIPTION OF THE EMBODIMENTS

The following discussion is presented to enable a person skilled in the art to make and use the invention. Various modifications to the preferred embodiment will be readily apparent to those skilled in the art, and the generic principles herein may be applied to other embodiments and applications, without departing from the spirit and scope of the present invention as defined by the appended claims. Thus, the present invention is not intended to be limited to the embodiment shown, but is to be accorded the widest scope consistent with the principles and features disclosed herein.

Figure 1:
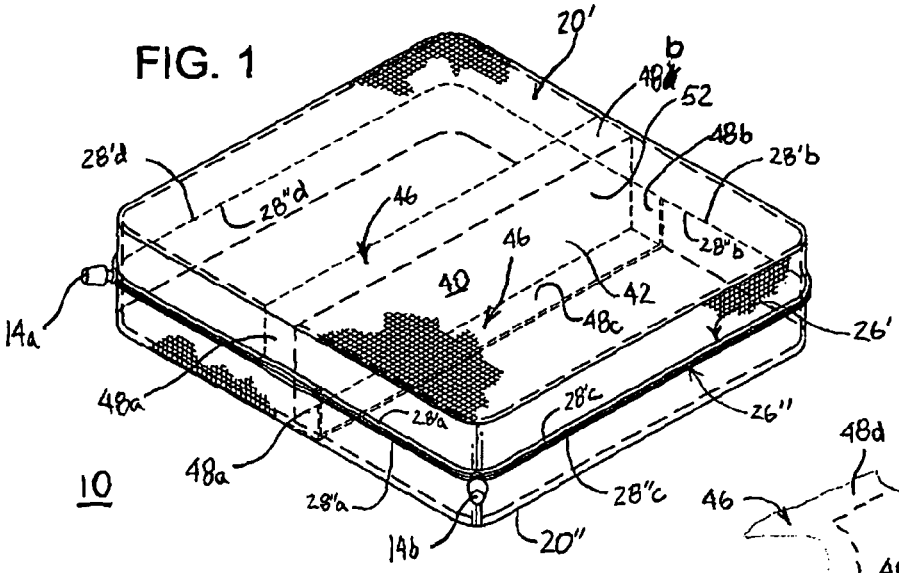
FIG. 1 is an exploded schematic view in perspective of a dual chamber inflatable member first embodiment according to the invention, with an internal intermediate panel shown in phantom and the foam elements removed for clarity.
Figure 2:
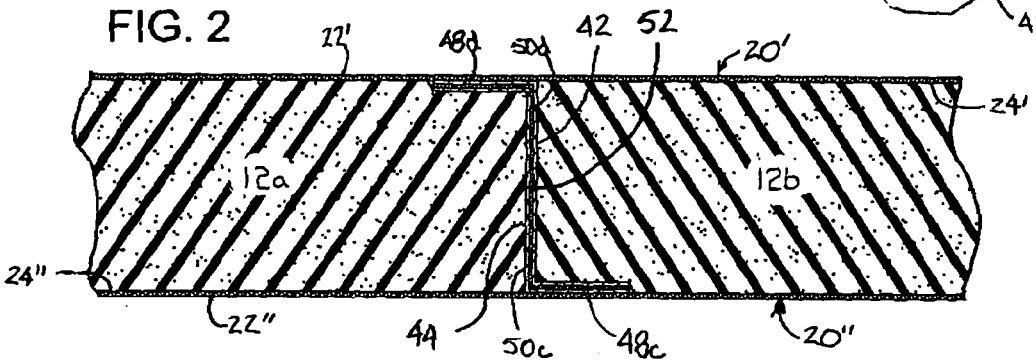
FIG. 2 is an elevation view in cross section of an assembled and inflated first embodiment particularly showing the folding of the intermediate panel.

Turning then to the several Figures wherein like numerals indicate like parts, and more particularly to FIGS. 1 and 2, a first embodiment of the invention is shown. Self-inflating seat cushion 10 comprises upper major panel 20', lower major panel 20", open cell foam elements 12*a* and 12*b*, which are separated from each other by intermediate panel 40, and valves 14*a* and 14*b*. Upper and lower major panels 20' and 20" are preferably constructed from a fabric material that has been treated to establish a fluid (including gas) impervious product. In preferred embodiments, a durable, low-slip polyester fabric is used and the treatment is a high melting point urethane applied to the inner surface of the fabric. As will be described in greater detail below, a second coating of, for example, a low melting point urethane is applied over the initial coating. In view of the objectives for these coatings, those persons skilled in the art will readily appreciate the myriad of means available for both establishing a desired fluid (including gas) barrier and establishing a bonding zone for tensile member adhesion, which in the illustrated embodiment are foam elements 12*a* and 12*b*.

Each major panel 20 has outer surface 22, inner surface 24 and perimeter 26. Each perimeter 26 in the illustrated embodiment comprises a plurality of opposing perimeter portions, e.g., opposing perimeter portions 28*a* and 28*b*, and 28*c* and 28*d*.

While means must be provided for adhering foam elements 12*a* and 12*b* to upper and lower major panels 20' and 20", the illustrated embodiment does not require the adhesion of either foam elements 12*a* or 12*b* to intermediate panel 40. Thus, while a fluid impervious quality is necessary for intermediate panel 40 if two fluidly sealed chambers are desired, it is only necessary to join or bond intermediate panel 40 to upper and lower major panels 20' and 20". Nevertheless, for manufacturing efficiencies it may be desirable to have similar qualities and materials to that of upper and lower major panels 20' and 20".

Figure 5:
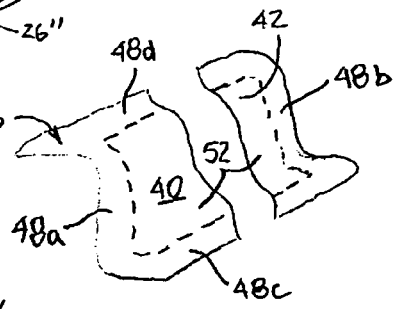
FIG. 5 is an isolated perspective view of the intermediate panel used to separate the two foam filled chambers of the inflatable member.

Intermediate panel 40 comprises first side 42, second side 44, perimeter 46, which includes opposing perimeter portions 48*a* and 48*b*, and 48*c* and 48*d* (see FIG. 5). In the illustrated embodiment, these perimeter portions are coated with a low melting point urethane to facilitate bonding of intermediate panel 40 to major panels 20' and 20" as well as to opposing perimeter portions 28'*a*/28"*a* and 28'*b*/28"*b*. As noted previously, any other means for achieving a secure and fluid impervious joinder or bond between these elements may be employed; use of a low melting point urethane is considered desirable in view of existing methods and apparatus used for creating single chambered inflatable bodies. Adjacent to respective opposing perimeter portions 48 are margin segments 50*a* and 50*b*, and 50*c* and 50*d* with central portion 52 being surrounded thereby. In the illustrated embodiment, only opposing perimeter portions 48*c* and 48*d* are joined to inner surfaces 24' and 24", and extend from opposing perimeter portions 28'*a* to 28'*b* for major panel 20' and from opposing perimeter portions 28"*a* to 28"*b* for major panel 20".

Valves 14*a* and 14*b* are conventional captive cap screw valves commonly found on THERMA-A-REST self-inflating pads manufactured by Cascade Designs, Inc. of Seattle, Wash. Skilled practitioners will understand that only a selectively sealable passageway is necessary to the operation of the illustrated embodiment, and therefore a host of functionally equivalent structures are possible.

As can be discerned from inspection of FIGS. 1 and 2, the joining or bonding of intermediate panel 40 to major panels 20' and 20" is done to create a "Z" configuration. As will now be described with respect to FIGS. 3 and 4, this geometry permits intermediate panel 40 to extend into perimeter 26 such that conventional inflatable mattress and pad manufacturing techniques can be used.

Figure 3:
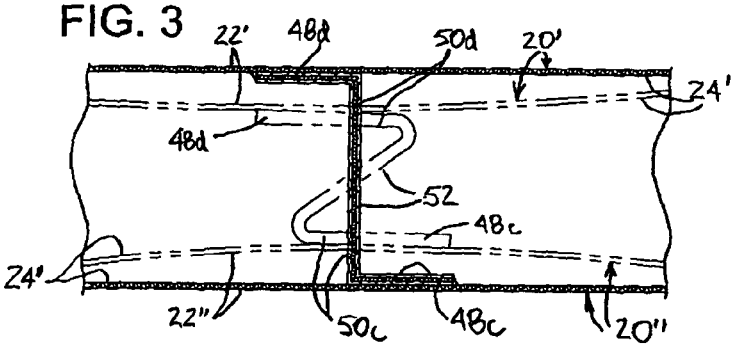
FIG. 3 is an elevation view in cross section of two major panels and a bonded intermediate panel prior to introduction of two foam slabs and subsequent compression bonding.
Figure 4:
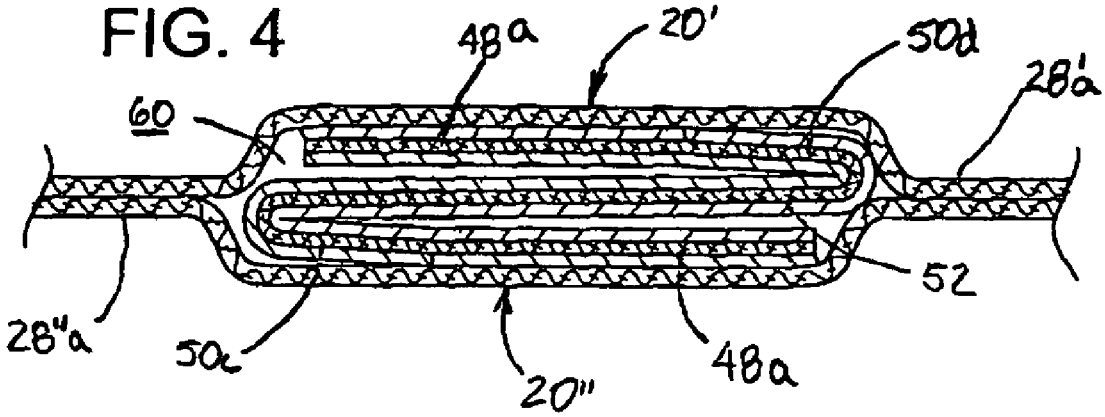
FIG. 4 is an elevation view in cross section of an inflatable member outer perimeter seam comprising two major panels and an intermediate panel perspective view of the intermediate panel with detail concerning the laminate composition thereof.

Turning then to FIGS. 3 and 4, the collapse and perimeter bonding of intermediate panel 40 is best shown. The phantom outline of intermediate panel 40 shown in FIG. 3 illustrates the preferred collapse of this panel both when cushion 10 is under compressive load and when approaching perimeter 26. During compression, opposing margin portions 50*c* and 50*d* migrate from being orthogonal to major panels 20' and 20" to being parallel thereto, e.g., a vertical orientation to a horizontal orientation. This movement causes the effective "height" of central portion 52 to decrease as the overall sectional height of cushion 10 decreases. This directionally biased collapsing is of particular benefit with respect to the mating of opposing perimeter portions 28'a and 28'b of major panel 20' to opposing perimeter portions 28"*a* and 28"*b* respectively of major panel 20" as is best illustrated in FIG. 4.

With reference to FIG. 4, it can be seen that opposing perimeter portion 48*c* is bonded to opposing perimeter portion 28"*a* and opposing perimeter portion 48*d* is bonded to opposing perimeter portion 28'*a*, while opposing margin portion 50*c* extends and turns back to central portion 52 and opposing margin portion 50*d* extends and also turns back to central portion 52. Because this view of intermediate panel 40 is at perimeter 26' and 26", the exposed edge is that of opposing perimeter portion 48*a*. As described earlier, at least those portions of perimeter 46 subject to joinder or bonding will have a coating of low melting point urethane to permit this portion of intermediate panel 40 to join or bond with other structure such as major panels 20' and 20" as well as itself. Thus, when cushion 10 is subject to compressive heating about perimeter 26' and 26" for the purpose of joining or bonding major panels 20'a to 20", liquefied low melting point urethane present at opposing perimeter portion 48*a* will migrate into void 60, thereby ensuring a sealing joinder or bond thereat.

While the illustrated "Z" geometry is considered preferred, any geometric arrangement that achieves the ability to extend the intermediate panel into the perimeter of the major panels and achieve a fluid impervious bond there between is considered within the scope of the invention.

What is claimed:

1. An inflatable body comprising:

a first major panel comprising a flexible sheet material having fluid impervious properties and having an outer surface, an inner surface and a perimeter;

a second major panel comprising a flexible sheet material having fluid impervious properties and having an outer surface, an inner surface and a perimeter;

an intermediate panel having fluid impervious properties and having a first surface, a second surface and a perimeter, wherein a first perimeter portion of the intermediate panel is joined to the inner surface of the first major panel from one perimeter portion of the first major panel to a generally opposed perimeter portion of the first major panel, wherein a second perimeter portion of the intermediate panel, which is generally opposed to the first perimeter portion, is joined to the inner surface of the second major panel from one perimeter portion of the second major panel to a generally opposed perimeter portion of the second major panel, and wherein the first major panel and second major panel perimeters are joined to each other to define a primary enclosure comprising a first and a second chamber separated by the intermediate panel, and at least one sealable orifice in fluid communication with the environment and at least one chamber.

2. The inflatable body of claim 1, further comprising a tensile member in one of the first or second chamber.

3. The inflatable body of claim 2, wherein the tensile member comprises an open cell foam material.

4. The inflatable body of claim 2, wherein the tensile member links the first major panel to the second major panel.

5. The inflatable body of claim 2, wherein the tensile member is not joined to a central portion of the intermediate panel.

6. The inflatable body of claim 1 comprising two sealable orifices, one for the first chamber and one for the second chamber.

7. The inflatable body of claim 1, wherein the first surface perimeter portion of the intermediate panel is joined to the inner surface of the first major panel.

8. The inflatable body of claim 1, wherein the second surface perimeter portion of the intermediate panel is joined to the inner surface of the second major panel.

9. The inflatable body of claim 1, wherein a thermoplastic is used to join the intermediate panel to the first and second major panels.

10. The inflatable body of claim 1, further comprising a tensile member in one of the first or second chamber, the tensile member lining the first major panel to the second major panel, and two sealable orifices, one for the first chamber and one for the second chamber, wherein the first surface perimeter portion of the intermediate panel is joined to the inner surface of the first major panel with a thermoplastic and the second surface perimeter portion of the intermediate panel is joined to the inner surface of the second major panel with a thermoplastic.

11. An inflatable body comprising:

a first major panel comprising a flexible sheet material having fluid impervious properties and having an outer surface, an inner surface and a perimeter;

a second major panel comprising a flexible sheet material having fluid impervious properties and having an outer surface, an inner surface and a perimeter;

an intermediate panel having fluid impervious properties and having a first surface, a second surface and a perimeter, wherein a first perimeter portion of the intermediate panel is joined to the inner surface of the first major panel from one perimeter portion of the first major panel to a generally opposed perimeter portion of the first major panel, wherein a second perimeter portion of the intermediate panel, which is generally opposed to the first perimeter portion, is joined to the inner surface of the second major panel from one perimeter portion of the second major panel to a generally opposed perimeter portion of the second major panel, and wherein the first major panel and second major panel perimeters are joined to each other to define a primary enclosure comprising a first and a second chamber separated by the intermediate panel, wherein the first and the second chambers each comprise at least one tensile member linking the inner surfaces of the first and the second major panels, and each chamber further comprises at least one sealable orifice in fluid communication with the environment and the respective chamber.

12. The inflatable body of claim 11, wherein the first surface perimeter portion of the intermediate panel is joined to the inner surface of the first major panel by a thermoplastic material.

13. The inflatable body of claim 11, wherein the second surface perimeter portion of the intermediate panel is joined to the inner surface of the second major panel by a thermoplastic material.

14. The inflatable body of claim 11, wherein the first surface perimeter portion of the intermediate panel is joined to the inner surface of the first major panel by a thermoplastic material, and the second surface perimeter portion of the intermediate panel is joined to the inner surface of the second major panel by a thermoplastic material.

15. The inflatable body of claim 11, wherein a fold geometry of the intermediate panel at the first and the second major surface perimeters approximates a "Z" configuration.

16. The inflatable body of claim 11, wherein at least the perimeter of the intermediate panel first and second surfaces is coated with a thermoplastic material.

17. The inflatable body of claim 11, wherein the inner surfaces of the first and the second major panels, and the first and second surfaces of the intermediate panel are coated with a low melting point urethane.

18. The inflatable body of claim 17, wherein the first surface perimeter portion of the intermediate panel is joined to the inner surface of the first major panel, and the second surface perimeter portion of the intermediate panel is joined to the inner surface of the second major panel.

19. The inflatable body of claim 11, wherein each orifice is located between the first major panel perimeter and the second major panel perimeter.

20. The inflatable body of claim 11, wherein the first, the second and the intermediate panels comprise a laminate structure of a fabric material coated on at least one side with a high melting point urethane and a low melting point urethane.

* * * * *